US009267666B2

(12) United States Patent
Takayama

(10) Patent No.: US 9,267,666 B2
(45) Date of Patent: Feb. 23, 2016

(54) ILLUMINATING APPARATUS

(71) Applicant: MINEBEA CO., LTD., Kitasaku-gun, Nagano (JP)

(72) Inventor: Ryohei Takayama, Fukuroi (JP)

(73) Assignee: MINEBEA CO., LTD., Kitasaku-gun (JP)

( * ) Notice: Subject to any disclaimer, the term of this patent is extended or adjusted under 35 U.S.C. 154(b) by 36 days.

(21) Appl. No.: 14/454,042

(22) Filed: Aug. 7, 2014

(65) Prior Publication Data

US 2015/0062916 A1 Mar. 5, 2015

(30) Foreign Application Priority Data

Sep. 5, 2013 (JP) ..... 2013-184074

(51) Int. Cl.

| | |
|---|---|
| ***F21V 13/04*** | (2006.01) |
| ***F21V 5/02*** | (2006.01) |
| ***F21V 5/04*** | (2006.01) |
| *F21Y 101/02* | (2006.01) |

(52) U.S. Cl.
CPC . *F21V 13/04* (2013.01); *F21V 5/02* (2013.01); *F21V 5/045* (2013.01); *F21Y 2101/02* (2013.01)

(58) Field of Classification Search
CPC ..... F21V 13/04; F21V 5/02; F21V 5/045
USPC ..... 362/308
See application file for complete search history.

(56) References Cited

FOREIGN PATENT DOCUMENTS

JP A-2004-311259 11/2004

*Primary Examiner* — Joseph L Williams
(74) *Attorney, Agent, or Firm* — Oliff PLC

(57) ABSTRACT

An illuminating apparatus includes a light source and an optical member that controls light distribution of light emitted from the light source in a forward direction. A plurality of prisms extending in one direction are provided on one principal surface of the optical member in regions on both sides when divided at a virtual plane that includes a reference axis. The plurality of prisms include reflecting prisms that reflect light from a light source that is disposed virtually on the reference axis and emit this light from the optical member. The light source is disposed such that its optical axis is shifted in one direction relative to the reference axis.

7 Claims, 7 Drawing Sheets

ILLUMINATING APPARATUS

BACKGROUND

1. Field of the Invention

The present invention relates to an illuminating apparatus in which the light distribution can be controlled.

2. Description of the Related Art

In illuminating apparatuses to be installed outside, various light distribution characteristics are generally required depending on the installation environment. For example, with regard to an illuminating apparatus such as a tunnel lamp or a roadway lamp, different light distribution characteristics may be required for a travelling direction and a width direction of the roadway, and light distribution characteristics that are asymmetrical relative to the reference axis of light distribution may also be required within a specific plane (e.g., a vertical plane parallel to the width direction).

As a typical example in which these kind of light distribution characteristics are required, there is a case in which tunnel lamps on an expressway are installed on a wall surface of only one side of the tunnel (e.g., refer to Japanese Patent Application Laid-Open (JP-A) No. 2004-311259 (refer to FIGS. 3 to 5)). In general, tunnel lamps on an expressway are required to illuminate the road surface as well as a predetermined range (e.g., within a range of a certain height from the road surface) of the wall surface on both sides within the tunnel in order to reduce driver's anxiety and the like. In order to satisfy this requirement, tunnel lamps on an expressway are normally installed facing each other on both wall surfaces of the tunnel such that the wall surface on one side (as well as the road surface) is illuminated by the tunnel lamps installed on the other wall surface. However, it is preferable to install tunnel lamps on a wall surface of only one side of the tunnel in terms of the cost of the tunnel lamps and their wiring fixtures, the ease of maintenance, and the like. In response to such problems, in the invention disclosed in JP-A No. 2004-311259, the light distribution characteristics of the tunnel lamps in a vertical plane (cross-section of the tunnel) parallel to the road width direction are configured to be asymmetrical relative to the reference axis of light distribution, thereby illuminating the road surface as well as both wall surfaces within the tunnel so as to satisfy a predetermined illumination standard with tunnel lamps installed on the wall surface of one side.

FIG. 12 illustrates the light distribution characteristics of the illuminating apparatus disclosed in JP-A No. 2004-311259. In FIG. 12, light distributions a and b within two mutually orthogonal planes including a light distribution reference axis of the illuminating apparatus (hereinafter also referred to as "optical axis of the illuminating apparatus" or simply "optical axis") C0 are indicated by a solid line and a dashed line, respectively. Herein, in FIG. 12, with regard to the angle around a photometric center O, the angle of the optical axis C0 is regarded as 0° and the counterclockwise direction is regarded as the positive direction.

As illustrated in FIG. 12, the light distribution a has peaks in both the positive and negative angular directions, and exhibits an asymmetrical distribution relative to the optical axis C0. Thus, in this light distribution, the distribution profile of a distribution A having a peak in the negative angular direction is different from that of a distribution B having a peak in the positive angular direction. In particular, the absolute value of the angle at which the peak occurs and the light intensity at the peak are different in each of the distributions A and B.

When using an illuminating apparatus having such light distribution characteristics as tunnel lamps installed on the wall surface of one side within a tunnel, a plane including the light distribution a illustrated in FIG. 12 corresponds to a vertical plane that is parallel to the width direction of the roadway. Further, the light distribution characteristics of the illuminating apparatus are adjusted according to the predetermined installation position, installation angle, and the like of the illuminating apparatus such that a predetermined range of the side wall on the side on which the illuminating apparatus is installed is illuminated by illumination light corresponding to the distribution A of the light distribution a, and a predetermined range of the side wall on the opposite side with the roadway therebetween is illuminated by illumination light corresponding to the distribution B of the light distribution a which is brighter than the distribution A. Thereby, the road surface as well as both side walls within the tunnel can be illuminated so as to satisfy a predetermined illumination standard.

JP-A No. 2004-311259 discloses the following as an illuminating apparatus having the above-described light distribution characteristics: an illuminating apparatus 100 including a straight tube-shaped fluorescent lamp 110 and a reflecting member 112 disposed on the rear side of the fluorescent lamp 110 (refer to FIG. 13). The reflecting member 112 is formed to have an inverse U-shaped cross-section by connecting a first and a second reflecting panel 113 and 114, whose reflecting surfaces are constituted by a single curved surface, to each other in a continuously integral manner at one end side thereof. Illumination light corresponding to the distribution A is generated when the first reflecting panel 113 reflects light from the fluorescent lamp 110, whereas illumination light corresponding to the distribution B which is brighter than the distribution A is generated when the second reflecting panel 114, whose reflecting surface is larger than the reflecting surface of the first reflecting panel 113, reflects light from the fluorescent lamp 110.

SUMMARY OF THE INVENTION

However, the following problems exist in the illuminating apparatus 100 which uses the reflecting member 112 consisting of the reflecting panels 113 and 114 for control of the light distribution of illumination light as disclosed in JP-A No. 2004-311259. First, since the reflecting member 112 is formed to have an inverse U-shaped cross-section, it is difficult to make the illuminating apparatus thin. Further, since the reflecting panels 113 and 114 are normally made of metal panels, the reflectivity of the reflecting panels 113 and 114 is low, and it is difficult to improve the utilization efficiency of light from the light source due to loss of light. In addition, since the reflecting panels 113 and 114 are molded by sheet-metal processing, it is difficult to achieve fine adjustment of the light distribution.

The present invention was created in consideration of the above-described problems, and an object thereof is to provide an illuminating apparatus that can easily control the light distribution while remaining thin and highly efficient.

The embodiments of the invention described below are examples of the structure of the present invention. In order to facilitate the understanding of the various structures of the present invention, the explanations below are divided into aspects. Each aspect does not limit the technical scope of the present invention, and the technical scope of the present invention can also include structures in which a portion of the components in the aspects below is substituted or deleted, or another component is added upon referring to the best modes for carrying out the invention.

According to a first aspect of the present invention, there is provided an illuminating apparatus including: a light source, and an optical member that controls light distribution of light emitted from the light source in a forward direction, wherein a plurality of prisms extending in one direction are provided on at least one among two principal surfaces of the optical member in regions on both sides when divided at a virtual plane that includes a reference axis of the optical member, the plurality of prisms include reflecting prisms that reflect light from a light source that is disposed virtually so as to include an optical axis on the virtual plane that includes the reference axis and emit the light from the optical member, and the light source is disposed such that its optical axis is shifted relative to the reference axis to a region on one side when divided at the virtual plane that includes the reference axis.

With this structure, light distribution that is asymmetrical relative to the optical axis of the light source can be realized within a plane that is orthogonal to the direction in which the plurality of reflecting prisms extend. Further, with this structure, this kind of light distribution control is carried out using an optical member in which a plurality of prisms are provided on at least one principal surface thereof, and the plurality of prisms include reflecting prisms. Thus, an illuminating apparatus that is thin and exhibits high efficiency with low loss of light can be realized. In addition, with this structure, the light distribution characteristics of the illuminating apparatus can be finely and easily adjusted based on the arrangement of the optical member and the light source, the optical design of the plurality of prisms provided to the optical member, and the like.

According to the first aspect of the present invention, a plurality of prisms disposed near the virtual plane that includes the reference axis are configured as refracting prisms that refract the light from the light source that is disposed virtually so as to include an optical axis on the virtual plane that includes the reference axis and emit the light from the optical member.

With this structure, compared to a case in which the plurality of prisms are constituted by only reflecting prisms, the occurrence of stray light caused by reflecting prisms can be suppressed, and in turn the light emitting efficiency can be improved and the controllability of the asymmetrical light distribution portion can be improved.

Also, with this structure, among the light distribution that is asymmetrical relative to the optical axis of the light source within a plane that is orthogonal to the direction in which the plurality of reflecting prisms extend, the balance between the amount of light of the primary (larger amount of light) distribution and the amount of light of the secondary (smaller amount of light) distribution can be easily adjusted by the action of the refracting prisms.

According to the first aspect of the present invention, a boundary between the reflecting prisms and the refracting prisms provided on a side on which the light source is disposed among the regions on both sides when divided at the virtual plane that includes the reference axis is located more toward the reference axis than the optical axis of the light source.

With this structure, when adjusting the balance between the amount of light of the primary (larger amount of light) distribution and the amount of light of the secondary (smaller amount of light) distribution among the light distribution that is asymmetrical relative to the optical axis of the light source within a plane that is orthogonal to the direction in which the plurality of reflecting prisms extend, the illuminating apparatus is particularly advantageous with respect to increasing the ratio of the amount of light of the secondary distribution relative to the amount of light of the primary distribution.

According to the first aspect of the present invention, the light source is disposed more toward the optical member than a focal point of the plurality of reflecting prisms.

With this structure, the light distribution of light emitted from the light source can be precisely adjusted in a broader range by adjusting the relative distance between the optical member and the light source relative to the focal length of the plurality of prisms.

According to the first aspect of the present invention, the plurality of prisms are divided into a plurality of small regions at at least one virtual plane parallel to the virtual plane that includes the reference axis, and one or more prisms disposed in each of the plurality of small regions are configured to have each different focal length than the focal length of the one or more prisms disposed in adjacent small regions.

With this structure, the light distribution of illumination light can be more precisely adjusted by adjusting the focal lengths of the one or more prisms disposed in each small region and the distance between the optical member and the light source relative to such focal lengths.

According to the first aspect of the present invention, one or more of the reflecting prisms disposed in each of the plurality of small regions included on a side on which the light source is disposed among the regions on both sides when divided at the virtual plane that includes the reference axis are configured such that the focal length thereof decreases as the small regions are distanced from the reference axis.

With this structure, the occurrence of stray light caused by the reflecting prisms can be suppressed, and decreases in the emitting efficiency can be reduced.

According to the first aspect of the present invention, the plurality of prisms is provided on a principal surface of the optical member that faces the light source, and each of the reflecting prisms includes a first surface that faces the reference axis and a second surface that reflects at least a portion of light that enters from the first surface to the side of the principal surface of the optical member on which the plurality of prisms are not provided.

With the structures described above, an illuminating apparatus that can easily control the light distribution while remaining thin and highly efficient can be provided.

DETAILED DESCRIPTION

Embodiments of the present invention will be explained below referring to the attached drawings. All of the drawings that illustrate the structure of an illuminating apparatus of the present invention (FIGS. 1, 3, 5, 7, 9, and 11) are schematic views that illustrate only the essential parts. Therefore, the illuminating apparatuses according to the embodiments of the present invention can include other constituent elements omitted from the drawings such as an enclosure that retains the illustrated constituent elements therewithin. Also, the relative dimensions of each illustrated portion are intended to exaggerate the features for the purpose of explanation, and do not necessarily reflect an actual reduced scale.

An illuminating apparatus 10 according to a first embodiment of the present invention includes a light source 12 and an optical member 14 arranged opposing the light source 12. In this embodiment, the optical member 14 is a sheet-shaped (thin panel-shaped) member including two principal surfaces 14*a* and 14*b*. One principal surface 14*b* is arranged facing the light source 12. Also, in this embodiment, the optical member 14 is formed in an approximately rectangular shape in a plan view. However, in the present invention, the outer shape of the optical member 14 is not particularly limited as long as it includes a plurality of prisms 15 to be explained later.

With regard to the term "sheet-shaped" mentioned above, for example, compared to the similar terms "panel-shaped" and "film-shaped", it has generally been suggested that a panel, a sheet (thin panel), and a film exhibit decreasing thickness in that order. However, "sheet-shaped" is not always differentiated from terms such as "panel-shaped" and "film-shaped" based on a clear technical meaning with respect to, for example, a thickness in the presence or absence of flexibility. Thus, in the present invention, the term "sheet-shaped" is used as a term that can be appropriately substituted with terms such as "panel-shaped" and "film-shaped" including "thin panel-shaped" in order to merely specifically indicate a shape that has two principal surfaces 14*a* and 14*b*.

Herein, in the illuminating apparatus 10, the direction from the light source 12 toward the optical member 14 is referred to as the "forward direction". In other words, the optical member 14 controls the light distribution of light emitted in the forward direction from the light source 12. Further, in the illuminating apparatus 10, the light source 12 is configured to emit light mainly in the forward direction. In addition, the light source 12 preferably emits light such that it spreads radially in the forward direction in at least a plane parallel to the paper surface in FIG. 1.

Figure 1:
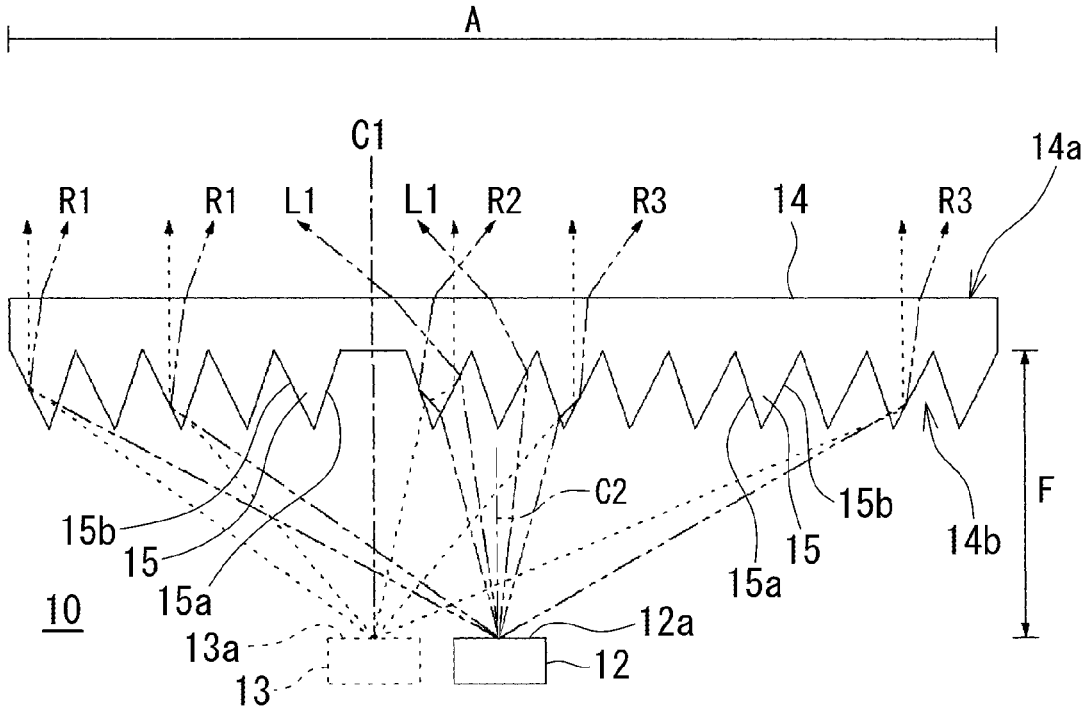
FIG. 1 is a side surface view illustrating the essential parts of an illuminating apparatus according to a first embodiment of the present invention.

With regard to the light source 12, the axis indicated by reference numeral C2 in FIG. 1 is a reference axis of light distribution of the light source 12. This axis is normally established as a virtual axis that is perpendicular to a light-emitting surface of the light source 12 and passes through the photometric center (a point estimated as an origin point of light that disperses from the light source 12) (hereinafter, the axis C2 will also be referred to as the optical axis C2 of the light source 12). In the illustrated example, for the sake of explanation, the light-emitting surface of the light source 12 corresponds to a front surface 12*a* in terms of the outer shape of the light source 12, and the photometric center thereof is positioned at the geometric center of the light-emitting surface 12*a*. However, in the illuminating apparatus 10, the light source 12 includes cases in which the light-emitting surface is unclear as a surface in the outer shape of the light source 12 or is a curved surface. In such cases, the light-emitting surface and the photometric center used in the definition of the optical axis C2 are respectively determined as an appropriate virtual surface and position considering the shape of the light source 12 and the like. In the following explanation, the light-emitting surface of the light source 12 is referred to using reference numeral 12*a* including the above-described cases. If the light source 12 has symmetrical light distribution around an axis perpendicular to the light-emitting surface 12*a*, the optical axis C2 is normally the axis of symmetry of this light distribution, and typically corresponds to the geometric center axis of the light-emitting surface 12*a*.

As will be explained below, the illuminating apparatus 10 controls the light distribution of light emitted from the light source 12 to a desired light distribution by the optical member 14, and emits light whose light distribution is controlled in this way as illumination light. However, the illuminating apparatus 10 is configured such that the reference axis of the light distribution of the illumination light (the optical axis of the illuminating apparatus 10) coincides with the optical axis C2 of the light source 12.

The optical member 14 includes a reference axis C1 that is a virtual axis that serves as a reference for the light distribution control effect of the optical member 14 (or a reference for arranging the plurality of prisms). A plurality of prisms 15 are provided on the principal surface 14*b* of the optical member 14 that faces the light source 12 based on the reference axis C1 as explained below.

The plurality of prisms 15 that extend in one direction (the direction orthogonal to the paper surface in FIG. 1) are provided on the principal surface 14*b* of the optical member 14 in regions on both sides when divided at a virtual plane (not illustrated; hereinafter also referred to as a "reference plane") including the reference axis C1. In FIG. 1, the reference plane is a virtual plane including the reference axis C1 that is orthogonal to the paper surface, and the plurality of prisms 15 extending parallel to the reference plane are aligned on the principal surface 14*b* of the optical member 14 in a direction that is orthogonal to the direction in which the prisms 15 extend and are provided in regions to the left side and the right side of the reference axis C1 in FIG. 1.

Furthermore, when the light source 12 used in the illuminating apparatus 10 is disposed virtually such that its optical axis C2 coincides with the reference axis C1, the plurality of prisms 15 include reflecting prisms that reflect light from the light source disposed in this way (a light source 13 indicated by dashed lines in FIG. 1) so that it is emitted from the optical member 14. In the illuminating apparatus 10, the plurality of prisms 15 are configured as these reflecting prisms 15 across an entire range A straddling the reference plane of the optical member 14.

Herein, each of the plurality of reflecting prisms 15 is a so-called TIR (Total Internal Reflection) prism. Specifically, each reflecting prism 15 includes a pair of prism surfaces 15*a* and 15*b* consisting of a first surface 15*a* that faces the reference axis C1 and a second surface 15*b* that faces the opposite side of the reference axis C1. Light emitted from the light source 13 enters each prism 15 from the first surface 15*a*, and at least a portion of the light that has entered proceeds toward the principal surface 14*a* (hereinafter also referred to as an "emitting surface 14*a*") of the optical member 14 on which the reflecting prisms 15 are not provided by total internal reflection at the second surface 15*b* and is emitted from the emitting surface 14*a* (refer to the light tracks indicated by the dashed line arrows in FIG. 11).

In addition, in the illustrated example, the plurality of reflecting prisms 15 are configured such that the focal point is located on the reference axis C1 with regard to the lens effect thereof. A light-emitting surface 13*a* of the light source 13 is located at this focal point, and light emitted radially from the light source 13 in at least a plane that is orthogonal to the direction in which the reflecting prisms 15 extend (within a plane parallel to the paper surface in FIG. 1) is converted to light that is substantially parallel to the optical axis C2 direction in this plane as schematically illustrated by the light tracks indicated by the dashed line arrows in FIG. 1.

In the illuminating apparatus 10, under the above-described structure of the optical member 14, the actual light source 12 is configured such that its optical axis C2 is disposed at a position that is shifted relative to the reference axis C1 to a region on one side when divided at the reference plane (the right side of the reference axis C1 in the example illustrated in FIG. 1). In more detail, in the illuminating apparatus 10, the light source 12 is disposed at a position that is shifted from the position at which the light source 13 is disposed to a region on one side when divided at the reference plane along a direction orthogonal to the reference plane in an orientation in which the optical axis C2 is maintained parallel to the reference axis C1. Thus, the distance between the optical member 14 and the light-emitting surface 12*a* of the light source 12 is the same as a focal length F of the plurality of reflecting prisms 15.

Herein, the optical member 14 normally has uniform optical characteristics in the direction in which the reflecting prisms 15 extend (the direction orthogonal to the paper surface in FIG. 1; hereinafter also referred to as a "vertical direction"). In this case, the position of the reference axis C1 in the vertical direction can be set to any appropriate position in accordance with the specific structure of the illuminating apparatus 10. For example, the position of the reference axis C1 in the vertical direction can be the center position in the vertical direction of the outer shape of the optical member 14.

In the above explanation, the light source 13 of the illuminating apparatus 10 was disposed such that its light-emitting surface 13*a* is positioned at the focal point on the reference axis C1. However, if the optical member 14 has uniform optical characteristics in the direction in which the reflecting prisms 15 extend, the focal points of the plurality of reflecting prisms 15 are distributed continuously linearly on the reference plane (in a direction orthogonal to the paper surface in FIG. 1). In this case, the position at which the light source 13 is disposed can be a position at which the optical axis thereof (omitted from the illustration associated with the light source 13, but will be referred to using reference numeral C2 similar to the optical axis C2 of the light source 12) and the reference axis C1 do not coincide as long as the optical axis C2 is included in the reference plane (in other words, coincides with any one of the virtual axes within the reference plane that are parallel to the reference axis C1) in accordance with the structure of the illuminating apparatus 10 and the like.

Also, in the above explanation, the position at which the light source 12 is disposed was set to a position shifted from the position at which the light source 13 is disposed along a direction orthogonal to the reference plane such that the position in the vertical direction of the optical axis C2 of the light source 12 coincides with the position in the vertical direction of the reference axis C1 (the optical axis C2 of the light source 13). However, in the illuminating apparatus 10, if the optical member 14 has uniform optical characteristics in the direction in which the reflecting prisms 15 extend, the position in the vertical direction at which the light source 12 is disposed is not necessarily limited to the above-described position, and can be set to any appropriate position in accordance with the structure of the illuminating apparatus 10 and the like.

Herein, in the illuminating apparatus 10, the light source 12 is preferably made of a point light source including a light-emitting diode. However, in the illuminating apparatus 10, the light source 12 can also be a linear light source. In this case, the light source 12 used in the illuminating apparatus 10 and the light source 13 in which the light source 12 is virtually disposed are arranged in the above-described predetermined position and orientation with regard to the light-emitting surfaces 12*a* and 13*a* and the optical axes C2, and are arranged such that the direction in which the linear light sources 12 and 13 extend coincides with the direction in which the plurality of reflecting prisms 15 extend. In the illuminating apparatus 10, such a linear light source can include, for example, a straight tube-shaped fluorescent tube, or a plurality of point light sources that are arranged linearly.

The operational effects of the illuminating apparatus 10 configured as described above are as follows.

In the following, a cross-section of the illuminating apparatus 10 that is orthogonal to the vertical direction (the direction in which the plurality of reflecting prisms 15 extend) is referred to as a "transverse cross-section". Further, the transverse cross-section including the optical axis C2 of the light source 12 typically includes the reference axis C1. However, in a typical optical member 14 having uniform optical characteristics in the vertical direction, light distribution control as described below is also achieved in the case that the reference axis C1 is not included in the transverse cross-section including the optical axis C2 of the light source 12. In this case, the term "reference axis C1" in the following explanation can be replaced with the phrase "an axis established upon projecting the reference axis C1 in the vertical direction on a transverse cross-section including the optical axis C2 of the light source 12".

In the illuminating apparatus 10, by configuring the light source 12 and the optical member 14 as described above, in the transverse cross-section including the optical axis C2, a portion of the emitted light from the light source 12 is emitted from the emitting surface 14*a* of the optical member 14 so as to be tilted relative to the optical axis C2 direction in a direction (the right direction in FIG. 1) in which the optical axis C2 is shifted from the reference axis C1 as illustrated by the light tracks schematically illustrated by dot-dot-dash line arrows R1 to R3 in FIG. 1. Further, another portion of the emitted light from the light source 12 is emitted from the emitting surface 14*a* of the optical member 14 so as to be tilted relative to the optical axis C2 direction in a direction (the left direction in FIG. 1) opposite to the direction in which the optical axis C2 is shifted from the reference axis C1 as illustrated by the light tracks schematically illustrated by a dot-dot-dash line arrow L1 in FIG. 1.

The above point will be explained in more detail below.

In the transverse cross-section including the optical axis C2, in the reflecting prisms 15 disposed on the side (the left side of the reference axis C1 in FIG. 1) on which the light source 12 is not disposed among the regions on both sides when divided at the reference plane, emitted light from the light source 12 enters into the reflecting prisms 15 from the first surface 15*a* of the reflecting prisms 15 similar to emitted light from the light source 13 that is virtually disposed, and then at least a portion of this light is reflected at the second surface 15*b* and emitted from the emitting surface 14*a* of the optical member 14 as illustrated by the dot-dot-dash line arrows R1 in FIG. 1. However, since the light source 12 is disposed at a position that is shifted in one direction (the right direction in FIG. 1) relative to the reference axis C1, this emitted light is emitted so as to be tilted in this shifted direction (the right direction in FIG. 1) relative to the optical axis C2 direction.

Further, in the transverse cross-section including the optical axis C2, in the reflecting prisms 15 which are on the opposite side of the reference axis C1 relative to the optical axis C2 of the light source 12 and are disposed at a position separated from the optical axis C2 among the reflecting prisms 15 disposed on the side (the right side of the reference axis C1 in FIG. 1) on which the light source 12 is disposed among the regions on both sides when divided at the reference plane, emitted light from the light source 12 enters into the reflecting prisms 15 from the first surface 15*a* of the reflecting prisms 15 similar to emitted light from the light source 13 that is virtually disposed, and then at least a portion of this light is reflected at the second surface 15*b* and emitted from the emitting surface 14*a* of the optical member 14 as illustrated by the dot-dot-dash line arrows R3 in FIG. 1. However, since the light source 12 is disposed at a position that is shifted in one direction (the right direction in FIG. 1) relative to the reference axis C1, this emitted light is emitted so as to be tilted in this shifted direction (the right direction in FIG. 1) relative to the optical axis C2 direction.

On the other hand, in the transverse cross-section including the optical axis C2, in the reflecting prisms 15 which are disposed near the optical axis C2 of the light source 12 (including the reflecting prisms 15 that are disposed on the opposite side of the reference axis C1 relative to the optical axis C2 and the reflecting prisms 15 disposed between the optical axis C2 of the light source 12 and the reference axis C1) and the reflecting prisms 15 which are disposed between the optical axis C2 of the light source 12 and the reference axis C1 (in a range that is not necessarily limited to near the optical axis C2 of the light source 12), emitted light from the light source 12 enters into the reflecting prisms 15 from the second surface 15*b* of the reflecting prisms 15 unlike the emitted light from the light source 13 that is virtually disposed, as illustrated by the dot-dot-dash line arrows L1 and R2 in FIG. 1. Most of this light that has entered from the second surface 15*b* of the reflecting prisms 15 is emitted from the emitting surface 14*a* of the optical member 14 without entering the first surface 15*a* as illustrated by the dot-dot-dash line arrows L1 in FIG. 1. As a result, this light is emitted so as to be tilted in a direction (the left direction in FIG. 1) that is opposite to the shifted direction of the light source 12 relative to the optical axis C2 direction.

Also, at least a portion of the light that has entered from the second surface 15*b* is reflected at the first surface 15*a* and emitted from the emitting surface 14*a* of the optical member 14 as illustrated by the dot-dot-dash line arrow R2 in FIG. 1. As a result, this light is emitted so as to be tilted in the shifted direction of the light source 12 (the right direction in FIG. 1) relative to the optical axis C2 direction.

Herein, in the illuminating apparatus 10, the light source 12 and the optical member 14 are configured and disposed such that most of the light that is emitted from the light source 12 and enters the optical member 14 is emitted so as to be tilted in the right direction relative to the optical axis C2 direction as illustrated by the light tracks indicated by the dot-dot-dash line arrows R1 to R3 in FIG. 1.

Hereinafter, in the transverse cross-section including the optical axis C2, when the emitting direction of light emitted from the emitting surface 14*a* of the optical member 14 is divided into two different directions, emitted light on the side at which the amount of emitted light is greater will be referred to as primary light, and emitted light on the side at which the amount of emitted light is smaller will be referred to as secondary light.

In the case of the illuminating apparatus 10, light that is emitted from the emitting surface 14*a* of the optical member 14 so as to be tilted relative to the optical axis C2 direction in a direction (the right direction in FIG. 1) in which the optical axis C2 is shifted from the reference axis C1 as illustrated by the light tracks schematically illustrated by the dot-dot-dash line arrows R1 to R3 in FIG. 1 is primary light R1 to R3, and light that is emitted from the emitting surface 14*a* of the optical member 14 so as to be tilted relative to the optical axis C2 direction in a direction (the left direction in FIG. 1) opposite to the direction in which the optical axis C2 is shifted from the reference axis C1 as illustrated by the light tracks schematically illustrated by the dot-dot-dash line arrows L1 in FIG. 1 is secondary light L1.

In this arrangement configuration of the light source 12 and the optical member 14, the average emission angle of the primary light R1 to R3 (tilt angle toward the right direction relative to the optical axis C2 direction) that is emitted from the emitting surface 14*a* of the optical member 14 is normally different from the average emission angle of the secondary light L1 (tilt angle toward the left direction relative to the optical axis C2 direction). Thereby, in the illuminating apparatus 10, illumination light emitted from the optical member 14 can realize asymmetrical light distribution for both the amount of light and the emission angle relative to the optical axis C2 of the light source 12 (in other words, the optical axis of the illuminating apparatus 10) in the transverse cross-section including the optical axis C2.

Further, in the illuminating apparatus 10, in the transverse cross-section including the optical axis C2, the average emission angle (tilt angle relative to the optical axis C2 direction) of the primary light R1 to R3 that is emitted from the emitting surface 14*a* of the optical member 14 increases as the distance in the transverse cross-section over which the optical axis C2 of the light source 12 is shifted relative to the reference axis C increases. Therefore, in this arrangement configuration of the light source 12 and the optical member 14, the emitting direction of the primary light R1 to R3 can be controlled by adjusting the distance in the transverse cross-section including the optical axis C2 between the reference axis C1 and the optical axis C2 of the light source 12.

In addition, in the transverse cross-section including the optical axis C2, as the distance in the transverse cross-section between the reference axis C1 and the optical axis C2 of the light source 12 increases, the number of reflecting prisms 15 that exists between the reference axis C1 and the optical axis C2 of the light source 12 increases, and thus the ratio of the amount of the secondary light L1 relative to the amount of the primary light R1 to R3 also increases. Therefore, in this arrangement configuration of the light source 12 and the optical member 14, the ratio of the amount of the secondary light L1 relative to the amount of the primary light R1 to R3 can be controlled by adjusting the distance in the transverse cross-section between the reference axis C1 and the optical axis C2 of the light source 12.

Also, in the illuminating apparatus 10, this kind of light distribution control is carried out using the optical member 14 which has a plurality of the reflecting prisms 15 on one principal surface 14*b* thereof. Thus, an illuminating apparatus 10 that is thin and exhibits high efficiency with low loss of light can be realized. Further, in the illuminating apparatus 10, the light distribution characteristics of the illuminating apparatus 10 can be finely and easily adjusted based on the arrangement configuration of the optical member 14 and the light source 12 and the optical design of the plurality of prisms 15 of the optical member 14.

Moreover, for example, if the light source 12 is constituted by a point light source with a relatively wide light-emitting surface area such as a so-called COB (Chip On Board) LED, light that enters the plurality of prisms 15 from a position separated from the optical axis C2 among the emitted light from the light source 12 has a narrower incident angle range than that of light that enters the plurality of prisms 15 from near the optical axis C2, and thereby it is easier to control the light distribution of this light. Thus, in the illuminating apparatus according to the present invention, in order to ensure efficiency and controllability of light distribution, it is preferable to dispose the reflecting prisms 15 which have excellent efficiency in regions separated from the optical axis C2 and to configure the plurality of the prisms 15 such that the majority thereof are reflecting prisms 15 so as to exhibit a light distribution control function. In the illuminating apparatus 10 according to the present embodiment, the plurality of prisms 15 are configured as these reflecting prisms 15 across the entire range A straddling the reference plane of the optical member 14, and thereby a configuration of the plurality of prisms 15 that is preferable from the above-described perspective is realized.

As described above, in the optical member 14, the plurality of reflecting prisms 15 normally have uniform optical characteristics in the direction in which the plurality of reflecting prisms 15 extend. Thus, the light distribution of the illumination light of the illuminating apparatus 10 in a plane that is orthogonal to the transverse cross-section including the optical axis C2 (hereinafter, this plane is also referred to as a "vertical cross-section") is a direct reflection of the light distribution within this plane of the light source 12. In particular, when the light distribution within the vertical cross-section including the optical axis C2 of the light source 12 is symmetrical relative to the optical axis C2, the light distribution within this plane of the illumination light is also symmetrical relative to the optical axis C2.

Figure 2:
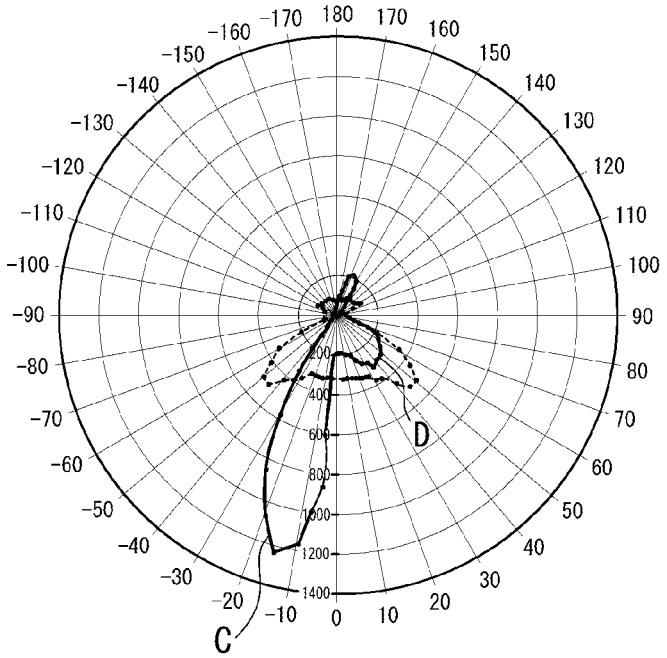
FIG. 2 is a graph illustrating the light distribution characteristics of the illuminating apparatus illustrated in FIG. 1.

FIG. 2 is a graph illustrating the results upon analyzing (simulation by ray tracing) the light distribution of illumination light in a model corresponding to the illuminating apparatus 10.

In the model used for this analysis, the refractive index of the optical member 14 was 1.58 (assuming a polycarbonate is used as the molding material), and the width of the plurality of reflecting prisms 15 in the arrangement direction (the left-right direction on the paper surface in FIG. 1) was 95 mm. The focal length F of the plurality of reflecting prisms 15 was set to 15 mm by setting the apex angle of the reflecting prisms 15 to 40° and the arrangement pitch to 50 μm and by adjusting the tilt angle of the prism surfaces 15*a* and 15*b* of the plurality of reflecting prisms 15 relative to the principal surface of the optical member 14 (e.g., the emitting surface 14*a*). Also, the light distribution of the light source 12 was modeled based on a light-emitting diode which is a point light source (a COB-type LED having a light-emitting diameter of 20 mm), and the distance that the optical axis C2 of the light source 12 is shifted from the reference axis C1 in the transverse cross-section including the optical axis C2 was 15 mm.

In FIG. 2, the coordinates in the circumferential direction indicate an angle of beam spread [°] when the optical axis C2 direction (forward direction) is 0°, and a negative angle corresponds to a tilt angle toward the right direction relative to the optical axis C2 direction in FIG. 1, whereas a positive angle corresponds to a tilt angle toward the left direction relative to the optical axis C2 direction in FIG. 1. The coordinates in the radial direction indicate a light intensity [cd]. In FIG. 2, a light distribution curve in the transverse cross-section including the optical axis C2 of illumination light of the illuminating apparatus 10 is illustrated with a solid line, and a light distribution curve in the vertical cross-section including the optical axis C2 is illustrated with a dashed line.

From the light distribution curve illustrated with a solid line in FIG. 2, it can be understood that in the illuminating apparatus 10, light distribution that is asymmetrical relative to the optical axis C2 is realized in the transverse cross-section including the optical axis C2 of illumination light. In this light distribution curve, the angle of beam spread at the distribution center of a light distribution C corresponding to the primary light is approximately −15°, and the angle of beam spread at the distribution center of a light distribution D corresponding to the secondary light is approximately 35°. Further, the ratio of the peak light intensity in the light distribution D corresponding to the secondary light relative to the peak light intensity in the light distribution C corresponding to the primary light is approximately 25%.

From the light distribution curve illustrated with a dashed line in FIG. 2, it can be understood that the light distribution in the vertical cross-section including the optical axis C2 of illumination light is substantially symmetrical relative to the optical axis C2.

Further, although not illustrated, similar analyses were also conducted using similar models in which the distance that the optical axis C2 of the light source 12 is shifted from the reference axis C1 in the transverse cross-section including the optical axis C2 was set to 0 mm, 5 mm, and 10 mm. From the above results as well as the results of these similar analyses, it was confirmed that the emission angle of the primary light as well as the ratio of the amount of secondary light relative to the amount of primary light are dependent on the distance that the optical axis C2 of the light source 12 is shifted from the reference axis C1 as described above.

The illuminating apparatus 10 having the above-described light distribution characteristics can be suitably used as, for example, a tunnel lamp that is installed on a wall surface of one side of a tunnel and illuminates the wall surfaces on both sides and the road surface within the tunnel. In this case, a plane having the light distribution illustrated with a solid line in FIG. 2 (the transverse cross-section including the optical axis C2) is set to coincide with a vertical plane that is parallel to the width direction of the roadway, and the light distribution characteristics of the illuminating apparatus 10 are adjusted in accordance with the predetermined installation position, installation angle, and the like of the illuminating apparatus 10 such that a predetermined range of the wall surface on the side on which the illuminating apparatus 10 is installed is illuminated by illumination light corresponding to the secondary light D and a predetermined range of the wall surface on the opposite side with the roadway therebetween is illuminated by illumination light corresponding to the primary light C which is brighter than the secondary light D. Thereby, the road surface as well as the wall surfaces on both sides within the tunnel can be illuminated so as to satisfy a predetermined illumination standard.

Also, the illuminating apparatus 10 can also be suitably used as a roadway lamp that is erected toward the road shoulder on one side in the width direction of a roadway on which sidewalks are provided on the outside of the road shoulder on both sides in the width direction to illuminate the sidewalks on both sides of the roadway as well as the road surface. In this case, a plane having the light distribution illustrated with a solid line in FIG. 2 (the transverse cross-section including the optical axis C2) is set to coincide with a vertical plane that is parallel to the width direction of the roadway, and the light distribution characteristics of the illuminating apparatus 10 are adjusted in accordance with the predetermined installation position, installation angle, and the like of the illuminating apparatus 10 such that the sidewalk on the side on which the illuminating apparatus 10 is installed is illuminated by illumination light corresponding to the secondary light D and the sidewalk on the opposite side with the roadway therebetween is illuminated by illumination light corresponding to the primary light C which is brighter than the secondary light D. Thereby, the road surface as well as the sidewalks on both sides can be illuminated so as to satisfy a predetermined illumination standard.

Next, referring to FIGS. 3 to 9, further embodiments of the illuminating apparatus of the present invention will be explained. In the explanation of the following embodiments, explanations of features that are the same as those in the previously explained embodiment(s) will be appropriately omitted, and the explanations will focus mainly on the unique features of each embodiment.

Figure 3:
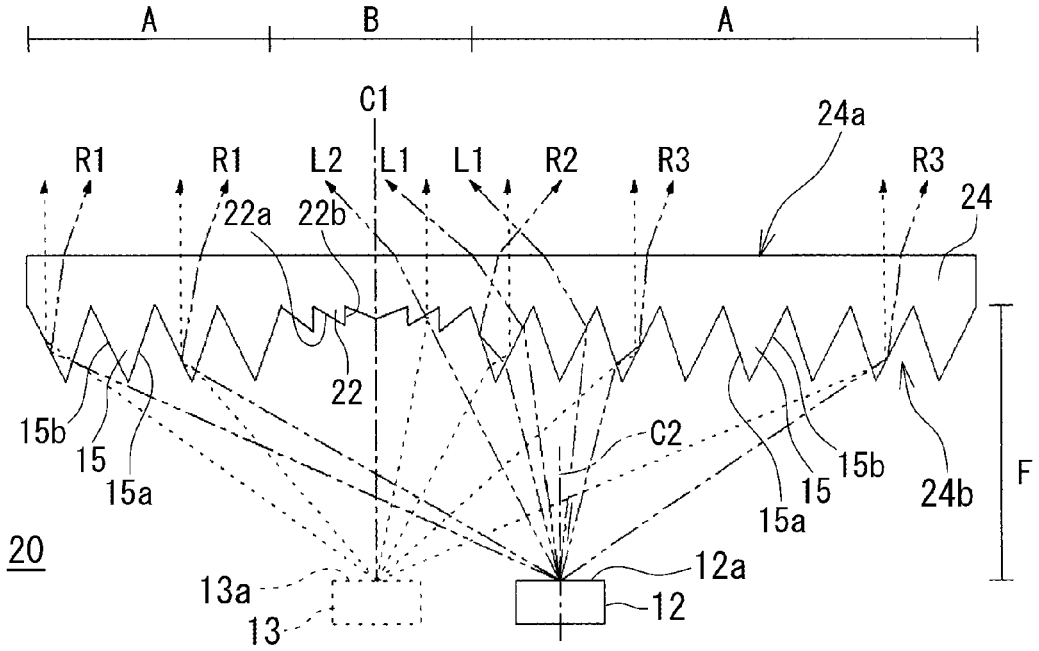
FIG. 3 is a side surface view illustrating the essential parts of an illuminating apparatus according to a second embodiment of the present invention.

The basic structure of an illuminating apparatus 20 of a second embodiment of the present invention illustrated in FIG. 3 is similar to that of the illuminating apparatus 10 illustrated in FIG. 1. However, the illuminating apparatus 20 differs from the illuminating apparatus 10 in that among the plurality of prisms 15 and 22 provided in regions on both sides when divided at the reference plane on a principal surface 24*b* of an optical member 24 facing the light source 12, the plurality of prisms 22 disposed near the reference plane (in the range indicated by B in FIG. 3) are configured as refracting prisms 22.

In the optical member 24, a plurality of reflecting prisms 15 similar to the reflecting prisms 15 of the illuminating apparatus 10 illustrated in FIG. 1 are provided on the outsides (in the ranges indicated by A in FIG. 3) of the range B near the reference plane among the regions on both sides when divided at the reference plane. Therein, the boundary between the reflecting prisms 15 and the refracting prisms 22 provided on the side on which the light source 12 is disposed (the right side of the reference axis C1 in FIG. 3) among the regions on both sides when divided at the reference plane is located more toward the reference axis C1 than the optical axis C2 of the light source 12.

Similar to the illuminating apparatus 10 illustrated in FIG. 1, the plurality of reflecting prisms 15 are configured such that the focal point is located on the reference axis C1 with regard to the lens effect thereof, and the light source 13 is disposed virtually such that the light-emitting surface 13*a* is located at this focal point.

When the light source 12 used in the illuminating apparatus 10 is disposed virtually such that its optical axis C2 coincides with the reference axis C1, the plurality of refracting prisms 22 refract light from the light source disposed in this way (the light source 13 indicated by dashed tracks in FIG. 3) so that it is emitted from the optical member 24.

Specifically, each refracting prism 22 includes a first surface 22*a* that is arranged tilted relative to a principal surface (e.g., an emitting surface 24*a*) of the optical member 24, and each of the plurality of prisms 22 refracts light that enters from the first surface 22*a*. Thereby, the refracting prisms 22 are configured to function as linear Fresnel lenses (corresponding to a cylindrical lens that protrudes toward a rear direction). Further, each refracting prism 22 (excluding the refracting prisms 22 whose first surfaces 22*a* are directly connected to each other from both sides of the reference axis C1 in the example illustrated in FIG. 3) also includes a second surface 22*b* that is approximately orthogonal to the principal surface of the optical member 24 and is connected to the first surface 22*a* of an adjacent refracting prism 22.

The illuminating apparatus 20 configured as described above achieves the same operational effects as the illuminating apparatus 10 described above. Therein, in the illuminating apparatus 20, by providing the plurality of reflecting prisms 15 on the optical member 24 on the outsides (the ranges indicated by A in FIG. 3) of the range B near the reference plane, a preferable configuration of the plurality of prisms 22 and 15 is realized for the case in which the light source 12 is constituted by a point light source with a relatively wide light-emitting surface area as described above.

In addition, the illuminating apparatus 20 also achieves the following unique operational effects compared to the illuminating apparatus 10.

First, in the illuminating apparatus 20, in the transverse cross-section including the optical axis C2 of the light source 12, light that is emitted from the light source 12 and enters into the refracting prisms 22 is emitted from the emitting surface 24*a* of the optical member 24 so as to be tilted relative to the optical axis C2 direction in a direction (the left direction in FIG. 1) opposite to the direction in which the light source 12 is shifted from the light source 13 as illustrated by the light line illustrated by a dot-dot-dash line arrow L2 in FIG. 3.

Basically, at least a portion of the light that is emitted from the light source 12 and becomes the primary light R2 due to the action of the reflecting prisms 15 disposed between the optical axis C2 and the reference axis C1 and the light that is emitted from the light source 12 and becomes the primary light R1 due to the action of the reflecting prisms 15 disposed near the reference axis C1 among the reflecting prisms 15 disposed on the side (the left side of the reference axis C1 in FIG. 1) on which the light source 12 is not disposed among the regions on both sides when divided at the reference plane in the illuminating apparatus 10 is emitted as secondary light L2 in the illuminating apparatus 20 and thus contributes to the overall light distribution.

Therefore, in the illuminating apparatus 20, replacing a portion of the reflecting prisms 15 with the refracting prisms 22 functions as a means for adjusting the balance between the amount of secondary light L1 and L2 and the amount of primary light R1 to R3 in accordance with the illumination standard of the environment in which the illuminating apparatus is installed and the like. In particular, the structure of the illuminating apparatus 20 is more advantageous than the illuminating apparatus 10 in terms of increasing the ratio of the amount of secondary light L1 and L2 relative to the amount of primary light R1 to R3.

Further, compared to the illuminating apparatus 10, the illuminating apparatus 20 is advantageous in terms of improving the light controllability and emitting efficiency as described below. In the reflecting prisms 15, the tilt angles of the pair of first and second surfaces 15*a* and 15*b* relative to the principal surface (e.g., the emitting surface 24*a*) of the optical member 24 are relatively large. Thus, for example, some light may leak to the outside upon passing through the first surface 15*a* after entering into the reflecting prism 15 from the second surface 15*b*, and this light is referred to as so-called stray light, which may inhibit the improvement of light controllability and emitting efficiency in the illuminating apparatus 20.

In contrast, the majority of light that is emitted from the light source 12 and enters into the plurality of refracting prisms 22 is more likely to enter into the refracting prisms 22 from the first surface 22*a*, whose tilt angle relative to the principal surface (e.g., the emitting surface 24*a*) of the optical member 24 is less than that of the first and second surfaces 15*a* and 15*b* of the reflecting prisms 15, and then be emitted from the emitting surface 24*a* of the optical member 24. Therefore, compared to the illuminating apparatus 10 in which all of the plurality of prisms are configured as reflecting prisms 15, the occurrence of stray light as described above can be suppressed, and in turn the light emitting efficiency can be improved and the controllability of the asymmetrical light distribution portion can be improved.

Figure 4:
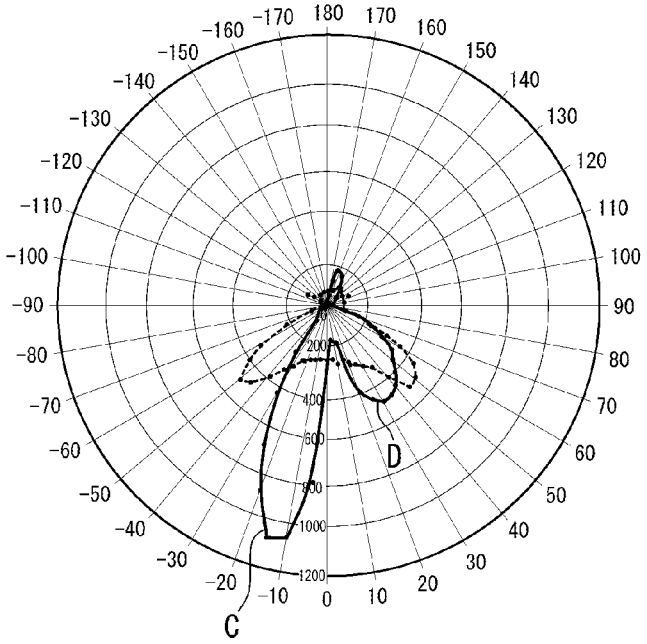
FIG. 4 is a graph illustrating the light distribution characteristics of the illuminating apparatus illustrated in FIG. 3.

FIG. 4 is a graph similar to FIG. 2 illustrating the results upon analyzing (simulation by ray tracing) the light distribution of illumination light in a model corresponding to the illuminating apparatus 20.

The conditions of the model used in this analysis are similar to those of the model corresponding to the illuminating apparatus 10 as described above in relation to FIG. 2, except that the plurality of refracting prisms 22 are set in a range of ±6 mm on both sides of the reference plane.

From the light distribution curve illustrated with a solid line in FIG. 4, it can be understood that in the illuminating apparatus 20 as well, light distribution that is asymmetrical relative to the optical axis C2 is realized in the transverse cross-section including the optical axis C2 of illumination light.

Further, in this light distribution curve, the ratio of the peak light intensity in the light distribution D corresponding to the secondary light relative to the peak light intensity in the light distribution C corresponding to the primary light is approximately 46%. Thus, it can be understood that the ratio of the amount of secondary light relative to the amount of primary light can be increased by replacing the plurality of reflecting prisms 15 disposed near the reference plane with the plurality of refracting prisms 22.

Herein, in the example illustrated in FIG. 3, the plurality of refracting prisms 22 are configured such that the plurality of refracting prisms 22 whose first surface 22*a* faces the opposite side of the reference axis C1 are disposed in the regions on both sides when divided at the reference plane, and the plurality of refracting prisms 22 in one region and the plurality of refracting prisms 22 in the other region are disposed symmetrically relative to the reference plane. However, in this case, the focal point of the plurality of refracting prisms 22 is not necessarily the same as the focal point of the plurality of reflecting prisms 15. Further, even if the plurality of refracting prisms 22 are provided in the regions on both sides when divided at the reference plane, the configuration of the plurality of refracting prisms 22 does not have to be symmetrical relative to the reference plane. For example, all of the refracting prisms 22 can be configured such that their first surfaces 22*a* face the side of the optical axis C2 of the light source 12 similar to the refracting prisms 22 disposed on the right side of the reference plane in FIG. 3. Also, in the illuminating apparatus 20, the plurality of refracting prisms 22 can be provided in the region on only one side (e.g., the side on which the light source 12 is disposed) when divided at the reference plane.

Figure 5:
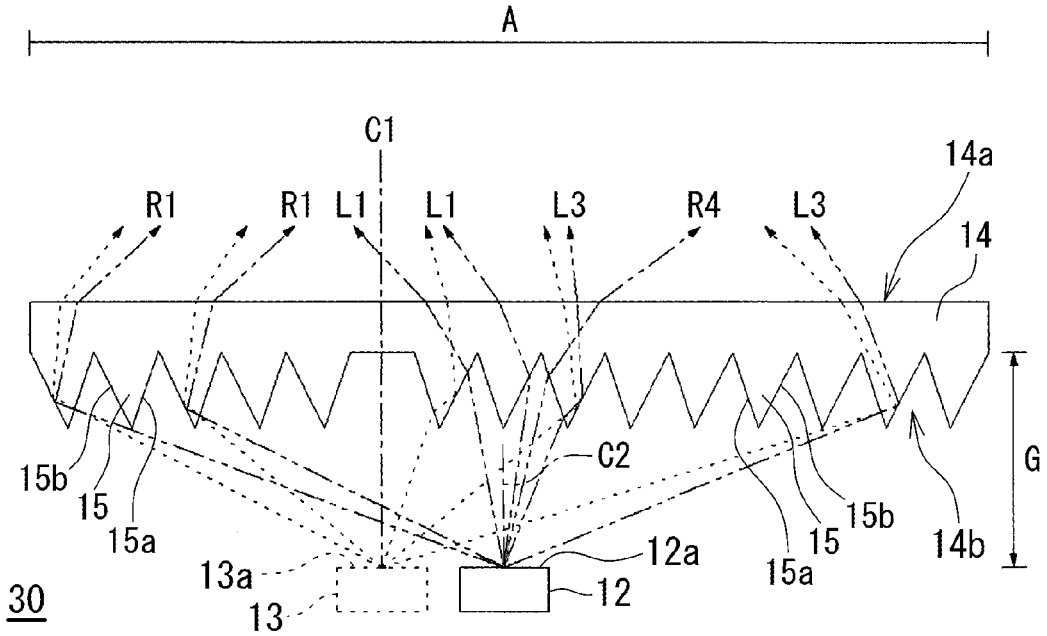
FIG. 5 is a side surface view illustrating the essential parts of an illuminating apparatus according to a third embodiment of the present invention.

The basic structure of an illuminating apparatus 30 of a third embodiment of the present invention illustrated in FIG. 5 is similar to that of the illuminating apparatus 10 illustrated in FIG. 1. However, the illuminating apparatus 30 differs from the illuminating apparatus 10 in that a distance G between the optical member 14 and the emitting surface 12*a* of the light source 12 is shorter than the focal length F of the plurality of reflecting prisms 15 and the light source 12 is disposed more toward the optical member 14 than the focal point of the plurality of reflecting prisms 15.

In addition to operational effects similar to those of the illuminating apparatus 10 described above, the illuminating apparatus 30 also achieves the following unique operational effects compared to the illuminating apparatus 10.

In the illuminating apparatus 30, as in the illuminating apparatus 10 illustrated in FIG. 1, in the transverse cross-section including the optical axis C2, in the reflecting prisms 15 disposed on the side (the left side of the reference axis C1 in FIG. 5) on which the light source 12 is not disposed among the regions on both sides when divided at the reference plane, emitted light from the light source 12 enters into the reflecting prisms 15 from the first surface 15*a* of the reflecting prisms 15 and then at least a portion of this light is reflected at the second surface 15*b* and emitted from the emitting surface 14*a* of the optical member 14 as illustrated by the dot-dot-dash line arrows R1 in FIG. 5.

However, in the illuminating apparatus 30, the emission angle (tilt angle relative to the optical axis C2 direction) of this emitted light R1 is larger than the emission angle of the emitted light R1 that is emitted by the action of the reflecting prisms 15 disposed in the same position in the illuminating apparatus 10 (in other words, the emission angle of this emitted light R1 approaches a direction parallel to the emitting surface 14*a* of the optical member 14). This emission angle increases as the distance G between the optical member 14 and the emitting surface 12*a* of the light source 12 decreases relative to the focal length F of the plurality of the prisms 15 by one or both of adjusting the focal length F of the plurality of prisms 15 and adjusting the distance G between the optical member 14 and the emitting surface 12*a* of the light source 12.

Meanwhile, in the transverse cross-section including the optical axis C2, in the reflecting prisms 15 which are on the opposite side of the reference axis C1 relative to the optical axis C2 of the light source 12 and are disposed at a position separated from the optical axis C2 among the reflecting prisms 15 disposed on the side (the right side of the reference axis C1 in FIG. 5) on which the light source 12 is disposed among the regions on both sides when divided at the reference plane, as illustrated in a dot-dot-dash line arrows L3 in FIG. 5, emitted light from the light source 12 enters into the reflecting prisms 15 from the first surface 15*a* of the reflecting prisms 15 and then at least a portion of this light is reflected at the second surface 15*b* as in the illuminating apparatus 10 illustrated in FIG. 1 (refer to the dot-dot-dash line arrows R3 in FIG. 1). However, unlike in the illuminating apparatus 10 illustrated in FIG. 1, when this reflected light is emitted from the emitting surface 14*a* of the optical member 14, it is emitted so as to be tilted relative to the optical axis C2 direction in a direction (the left direction in FIG. 5) opposite to the direction in which the light source 12 is shifted from the light source 13.

In the illuminating apparatus 30, the amount of this emitted light L3 increases as the distance G between the optical member 14 and the emitting surface 12*a* of the light source 12 decreases relative to the focal length F of the plurality of prisms 15 by one or both of adjusting the focal length F of the plurality of prisms 15 and adjusting the distance G between the optical member 14 and the emitting surface 12*a* of the light source 12.

In particular, in the illuminating apparatus 30, by decreasing the distance G between the optical member 14 and the emitting surface 12*a* of the light source 12 relative to the focal length F of the plurality of prisms 15 as described above, the amount of light that is emitted from the emitting surface 14*a* of the optical member 14 so as to be tilted relative to the optical axis C2 direction in a direction (the left direction in FIG. 5) opposite to the direction in which the optical axis C2 is shifted from the reference axis C1 as illustrated by the light tracks schematically illustrated by the dot-dot-dash line arrows L1 and L3 in FIG. 5 can be increased compared to the amount of light emitted from the emitting surface 14*a* of the optical member 14 so as to be tilted relative to the optical axis C2 direction in a direction (the right direction in FIG. 5) in which the optical axis C2 is shifted from the reference axis C1 as illustrated by the light tracks schematically illustrated by the dot-dot-dash line arrows R1 and R4 in FIG. 5. In this case, the emitted light L1 and L3 becomes primary light and the emitted light R1 and R4 becomes secondary light.

In this way, in the illuminating apparatus 30, by adjusting the distance G between the optical member 14 and the emitting surface 12*a* of the light source 12 relative to the focal length F of the plurality of prisms 15, the light distribution of light emitted from the light source 12 can be precisely adjusted in a broader range. Further, the light L1 and L3 that is emitted so as to be tilted in a direction (the left direction in FIG. 5) opposite to the direction in which the optical axis C2 is shifted from the reference axis C1 generally has a relatively broad distribution at the tilt angle relative to the optical axis C2 direction. Thus, the illuminating apparatus 30 is advantageous in that, by configuring the emitted light L1 and L3 as primary light, it can achieve relatively broad light distribution with respect to the primary light L1 and L3 in accordance with the illumination standard of the environment in which the illuminating apparatus is installed and the like.

Furthermore, in the illuminating apparatus 30, among the light emitted from the light source 12, light that enters into the reflecting prisms 15 disposed near the optical axis C2 of the light source 12 from a portion of the first surface 15*a* near the emitting surface 14*a* of the optical member 14 is emitted from the emitting surface 14*a* of the optical member 14 without entering and being reflected at the second surface 15*b* as illustrated by the dot-dot-dash line arrow R4 in FIG. 5. As a result, this light is emitted so as to be tilted in a direction (the right direction in FIG. 5) in which the light source 12 is shifted relative to the optical axis C2 direction.

This emitted light R4 is emitted from the light source 12 near the optical axis C2, and thus the amount thereof is normally large. Therefore, this light greatly contributes to increasing the amount of light R1 and R4 emitted from the emitting surface 14*a* of the optical member 14 so as to be tilted relative to the optical axis C2 direction in a direction (the right direction in FIG. 5) in which the optical axis C2 is shifted from the reference axis C1 among the overall emitted light distribution. Further, the emission angle (the tilt angle relative to the optical axis C2 direction) of the emitted light R4 tends to be large.

Thereby, light distribution control by broadening the angle between the average emitting direction of the primary light L1 and L3 and the average emitting direction of the secondary light R1 and R4 can be easily carried out. Thus, for example, when using the illuminating apparatus 30 as a tunnel lamp or a roadway lamp, light distribution suitable for a tunnel lamp or roadway lamp can be easily achieved in accordance with the illumination standard of the installation environment and the like.

Figure 6:
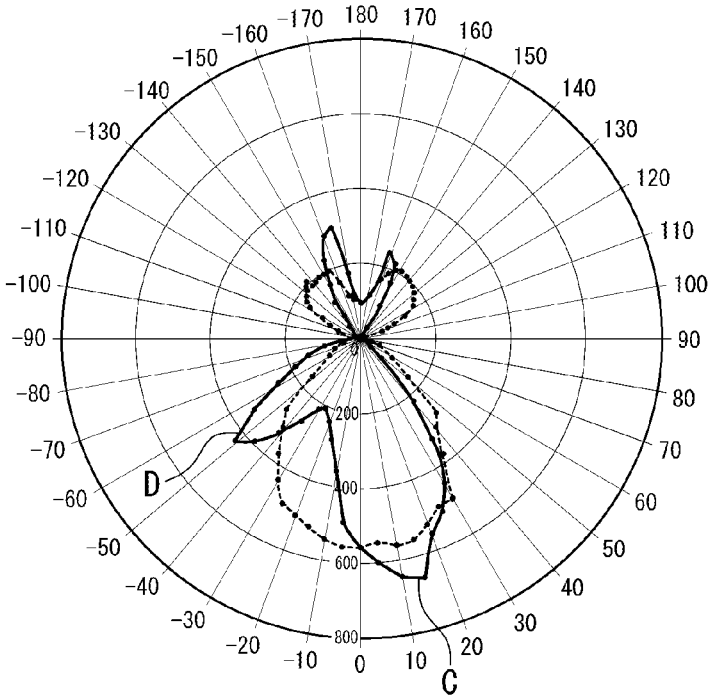
FIG. 6 is a graph illustrating the light distribution characteristics of the illuminating apparatus illustrated in FIG. 5.

FIG. 6 is a graph similar to FIG. 2 illustrating the results upon analyzing (simulation by ray tracing) the light distribution of illumination light in a model corresponding to the illuminating apparatus 30.

The conditions of the model used in this analysis are similar to those of the model corresponding to the illuminating apparatus 10 as described above in relation to FIG. 2, except that the distance G between the emitting surface 12*a* of the light source 12 and the optical member 14 was set to 15 mm relative to the focal length F (80 mm) of the plurality of reflecting prisms 15.

From the light distribution curve illustrated with a solid line in FIG. 6, it can be understood that in the illuminating apparatus 30 as well, light distribution that is asymmetrical relative to the optical axis C2 is realized in the transverse cross-section including the optical axis C2 of illumination light. However, in this light distribution curve illustrated with a solid line in FIG. 6, the distribution center of the light distribution C corresponding to the primary light occurs in the positive direction of the angle of beam spread (tilt angle toward the left direction relative to the optical axis C2 direction in FIG. 5), and the value thereof is about 15°. Also, from this light distribution curve, it can be understood that the light distribution C of the primary light exhibits a half-value width that is prominently wider than that of the light distribution C of the primary light in the light distribution curve illustrated with a solid line in FIG. 2 with regard to the illuminating apparatus 10.

Further, in the light distribution curve illustrated with a solid line in FIG. 6, the angle of beam spread of the distribution center of the light distribution D corresponding to the secondary light occurs in the negative direction of the angle of beam spread (tilt angle toward the right direction relative to the optical axis C2 direction in FIG. 5), and the value thereof is about −50°. From this, it can be understood that the absolute value of this angle of beam spread is greater than the angle of beam spread (about 35°) at the distribution center of the light distribution D of the secondary light in the light distribution curve illustrated with a solid line in FIG. 2 with regard to the illuminating apparatus 10.

Figure 7:
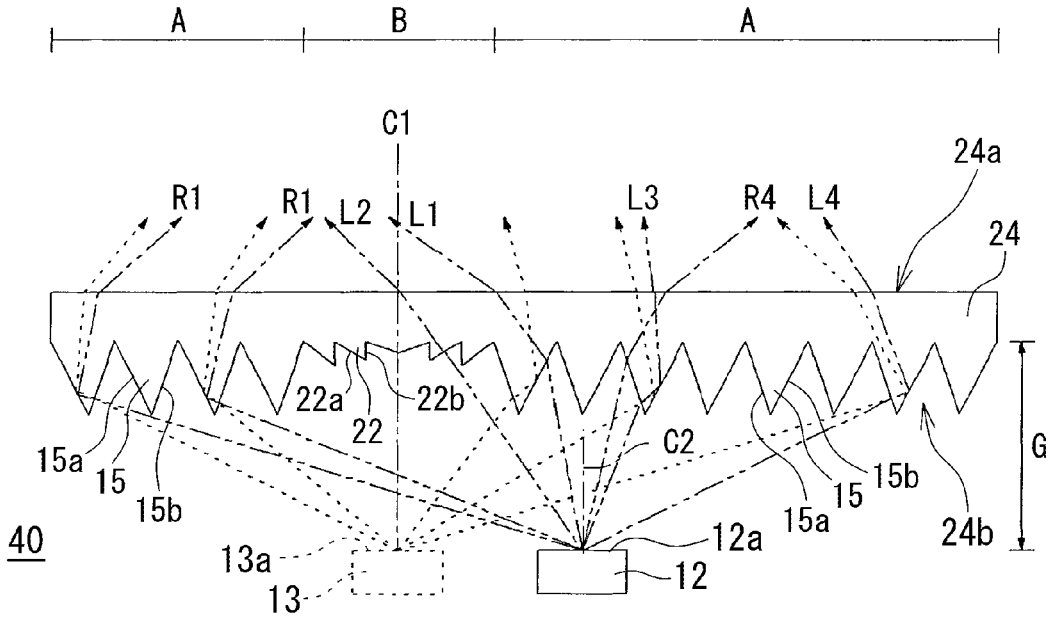
FIG. 7 is a side surface view illustrating the essential parts of another example of the illuminating apparatus according to the third embodiment of the present invention.

FIG. 7 is a side surface view illustrating the essential parts of another example of the illuminating apparatus according to the third embodiment of the present invention. The basic structure of an illuminating apparatus 40 illustrated in FIG. 7 is similar to that of the illuminating apparatus 20 illustrated in FIG. 3. However, the illuminating apparatus 40 differs from the illuminating apparatus 20 in that the distance G between the optical member 14 and the emitting surface 12*a* of the light source 12 is smaller than the focal length F of the plurality of reflecting prisms 15 and the light source 12 is disposed more toward the optical member 14 than the focal point of the plurality of reflecting prisms 15.

In addition to operational effects similar to those of the illuminating apparatus 30 illustrated in FIG. 5, the illuminating apparatus 40 configured as described above also achieves operational effects similar to those of the illuminating apparatus 20 illustrated in FIG. 3 with respect to including the plurality of refracting prisms 22.

Figure 8:
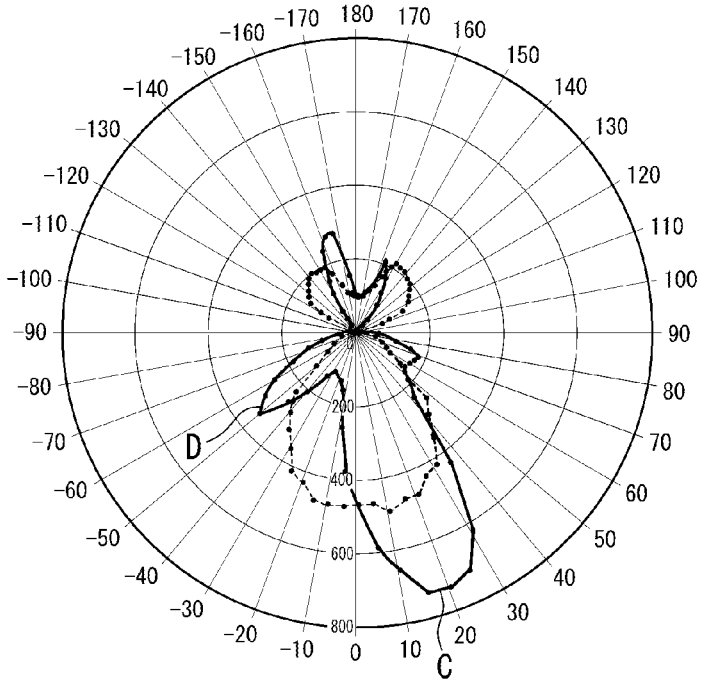
FIG. 8 is a graph illustrating the light distribution characteristics of the illuminating apparatus illustrated in FIG. 7.

FIG. 8 is a graph similar to FIG. 2 illustrating the results upon analyzing (simulation by ray tracing) the light distribution of illumination light in a model corresponding to the illuminating apparatus 40.

The conditions of the model used in this analysis are similar to those of the model corresponding to the illuminating apparatus 20 as described above in relation to FIG. 3, except that the distance G between the emitting surface 12*a* of the light source 12 and the optical member 14 was set to 15 mm relative to the focal length F (80 mm) of the plurality of refracting prisms 22. The focal length of the plurality of refracting prisms 22 does not necessarily have to be the same as the focal length F of the reflecting prisms 15, and in the present embodiment, the focal length of the plurality of refracting prisms 22 is set to 15 mm, which is the distance between the emitting surface 12*a* of the light source 12 and the optical member 14.

From the light distribution curve illustrated with a solid line in FIG. 8, it can be understood that the illuminating apparatus 40 has features relative to the illuminating apparatus 20 similar to the features described above of the illuminating apparatus 30 relative to the illuminating apparatus 10.

Figure 9:
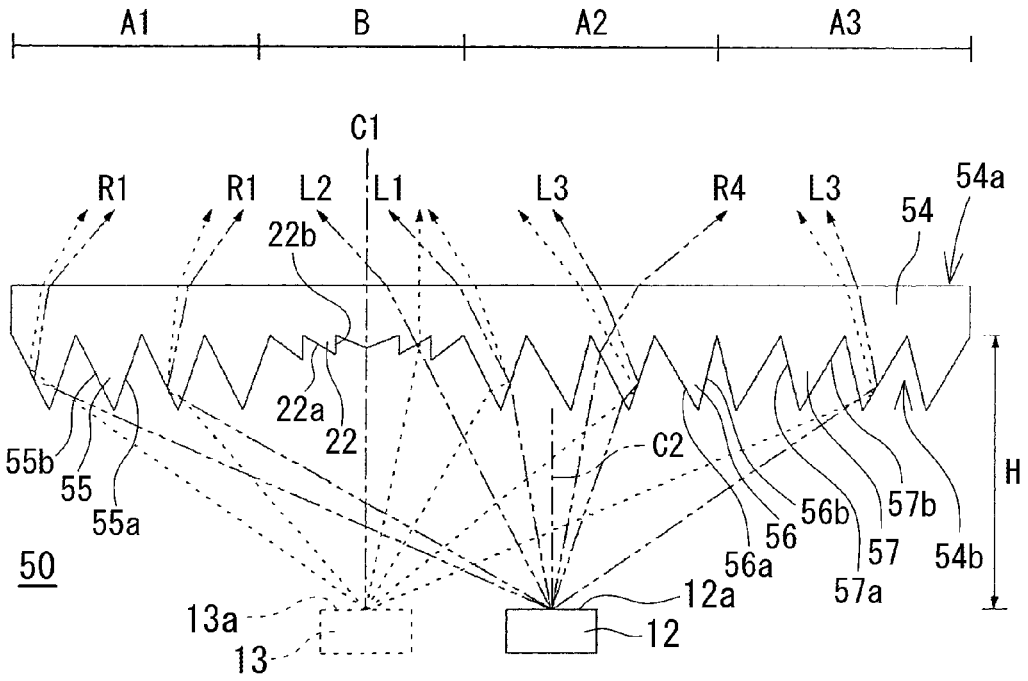
FIG. 9 is a side surface view illustrating the essential parts of an illuminating apparatus according to a fourth embodiment of the present invention.

Next, an illuminating apparatus 50 according to a fourth embodiment of the present invention will be explained referring to FIG. 9. The illuminating apparatus 50 illustrated in FIG. 9 includes the light source 12 and an optical member 54 opposing the light source 12. A plurality of prisms 55, 22, 56, and 57 that extend in one direction (the direction orthogonal to the paper surface in FIG. 9) are provided on a principal surface 54*b* of the optical member 54 in regions on both sides when divided at a reference plane (a virtual plane including the reference axis C1). In FIG. 9, the reference plane is a virtual plane that includes the reference axis C1 and is orthogonal to the paper surface. The plurality of prisms 55, 22, 56, and 57 which extend parallel to the reference plane are arranged on the principal surface 54*b* of the optical member 54 in a direction that is orthogonal to the direction in which the prisms 55, 22, 56, and 57 extend, and are provided in regions to the left side and the right side of the reference axis C1 in FIG. 9.

In the illuminating apparatus 50, the plurality of prisms 55, 22, 56, and 57 are divided into a plurality (four in FIG. 9) of small regions A1, B, A2, and A3 at one or more (three in FIG. 9) virtual planes (not illustrated) that are parallel to the reference plane, and one or more prisms 55, 22, 56, and 57 are disposed in each of the plurality of small regions A1, B, A2, and A3. The small regions A1, B, A2, and A3 include a small region that includes the reference axis C1 (the small region B in FIG. 9) and small regions A1, A2, and A3 that are provided outside of the small region B including the reference axis C1. The optical axis C2 of the light source 12 is disposed so as to be included in one of the small regions A1, A2, and A3 provided outside of the reference axis C1 (the small region A2 adjacent on the right to the small region B in FIG. 9).

In FIG. 9, the plurality of the prisms 55, 22, 56, and 57 are disposed in all of the small regions A1, B, A2, and A3. However, in the illuminating apparatus 50, it is sufficient as long as at least one prism 55, 22, 56, and 57 is disposed in each of the small regions A1, B, A2, and A3.

In the illuminating apparatus 50, the one or more prisms 55, 22, 56, and 57 disposed in adjacent small regions A1, B, A2, and A3 are configured to have mutually different focal lengths.

In other words, in the example illustrated in FIG. 9, at the very least, the focal length of the plurality of prisms 55 included in the small region A1 is different from the focal length of the plurality of prisms 22 included in the small region B, and the focal length of the plurality of prisms 22 included in the small region B is different from the focal length of the plurality of prisms 56 included in the small region A2, and the focal length of the plurality of prisms 56 included in the small region A2 is different from the focal length of the plurality of prisms 57 included in the small region A3. However, for example, the focal lengths of the plurality of prisms 55 and 57 included in the small regions A1 and A3, which are not adjacent, can be the same.

In the example illustrated in FIG. 9, among the plurality of small regions A1, B, A2, and A3, the plurality of prisms 22 included in the small region B near the reference axis C are configured as refracting prisms 22, and the plurality of prisms 55, 56, and 57 included in the small regions A1, A2, and A3 outside of the small region B are configured as reflecting prisms 55, 56, and 57.

Therein, the one or more reflecting prisms 56 and 57 disposed in each of the plurality of small regions A2 and A3 included on the side (the right side of the reference axis C1 in FIG. 9) on which the light source 12 is disposed among the regions on both sides when divided at the reference plane are configured such that the focal length thereof decreases the farther away the small regions A2 and A3 are from the reference axis C1. In other words, in the example illustrated in FIG. 9, the focal length of the plurality of reflecting prisms 57 disposed in the small region A3 is shorter than the focal length of the plurality of reflecting prisms 56 disposed in the small region A2.

In the illuminating apparatus 50, a distance H between the optical member 54 and the emitting surface 12*a* of the light source 12 is appropriately set in accordance with the desired light distribution control by the optical member 54.

In the illuminating apparatus 50 configured as described above, asymmetrical light distribution for both the amount of light and the emission angle is realized relative to the optical axis C2 in the transverse cross-section including the optical axis C2, similar to the illuminating apparatuses 10, 20, 30, and 40 according to the first to third embodiments described above.

In addition, in the illuminating apparatus 50, by adjusting the focal length of each small region A1, B, A2, and A3 as well as the distance H between the optical member 54 and the emitting surface 12*a* of the light source 12 relative to these focal lengths, the light distribution of the illumination light can be more precisely adjusted.

Further, in the illuminating apparatus 50, by configuring the one or more reflecting prisms 56 and 57 disposed in each of the plurality of small regions A2 and A3 included on the side (the right side of the reference axis C1 in FIG. 9) on which the light source 12 is disposed among the regions on both sides when divided at the reference plane such that the focal length thereof decreases the farther away the small regions A2 and A3 are from the reference axis C1, the occurrence of stray light (e.g., light that enters the reflecting prisms 57 from a first surface 57*a*, is reflected at a second surface 57*b*, and then reenters the first surface 57*a* and leaks to the outside upon passing through the first surface 57*a*) can be suppressed, and decreases in the emitting efficiency can be reduced.

In the illuminating apparatus 50 illustrated in FIG. 9, the distance H between the optical member 54 and the emitting surface 12*a* of the light source 12 is set to be shorter than the focal lengths of the plurality of reflecting prisms 55, 56, and 57 disposed in the small regions A1, A2, and A3, and the plurality of refracting prisms 22 are disposed in the small region B that is near the reference axis C1. Therefore, the illuminating apparatus 50 basically achieves operational effects similar to those of the illuminating apparatus 40 illustrated in FIG. 7 as well as the operational effects unique to the illuminating apparatus 50 described above.

In the example illustrated in FIG. 9, one small region A1 is provided on the side (the left side of the reference axis C1 in FIG. 9) on which the light source 12 is not disposed among the regions on both sides when divided at the reference plane, and one small region B is provided near the reference axis C1 straddling the regions on both sides when divided at the reference plane. However, in the illuminating apparatus 50, these small regions A1 and B can be further divided into multiple small regions.

Figure 10:
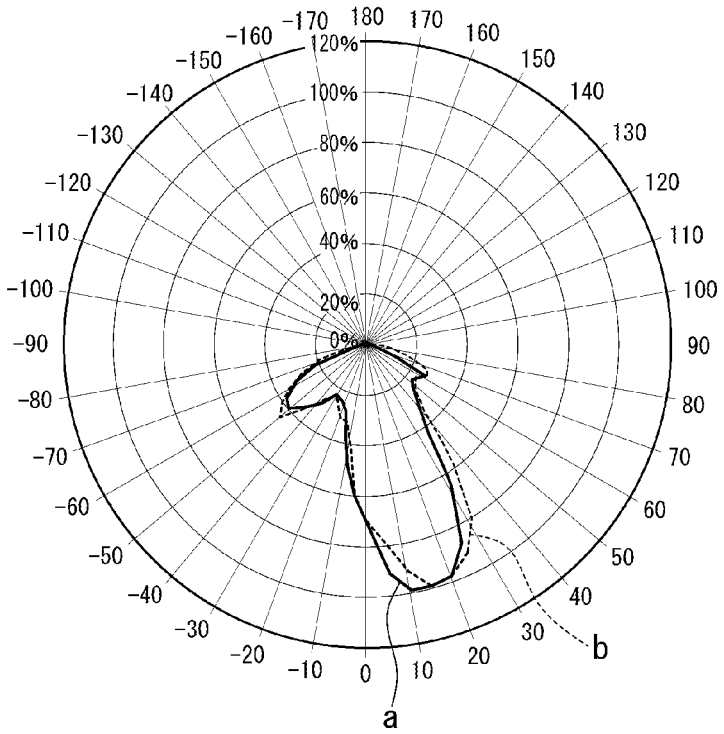
FIG. 10 is a graph illustrating the light distribution characteristics of the illuminating apparatus illustrated in FIG. 7 together with measurement results using an actual device.

FIG. 10 is a graph similar to FIG. 2 illustrating the results upon fabricating an actual device corresponding to the illuminating apparatus 40 illustrated in FIG. 7 and measuring the light distribution of illumination light thereof, together with the results upon analysis of the light distribution of illuminating light in a model corresponding to the illuminating apparatus 40. In FIG. 10, the light distribution curve illustrated with a solid line is the measurement results of the actual device, and the light distribution curve b illustrated with a dashed line is the analysis results of the model. Comparing these light distribution curves a and b, the light distribution of the actual device and the light distribution upon analyzing the model match well, and from these results the effectiveness of the illuminating apparatus according to the present invention was confirmed.

The present invention was explained above based on preferred embodiments thereof. However, the illuminating apparatus according to the present invention is not limited to the above embodiments.

Figure 11:
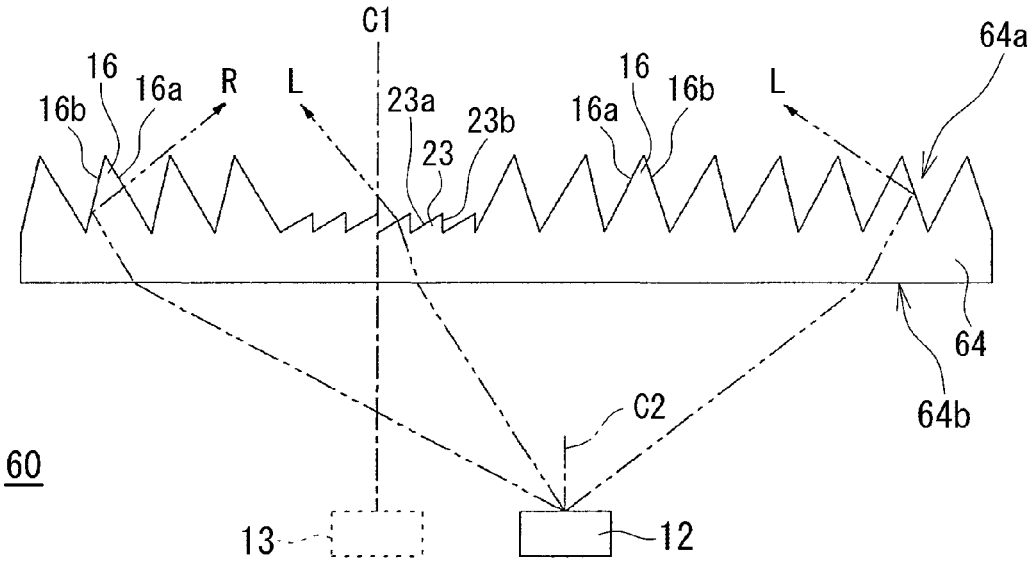
FIG. 11 is a side surface view illustrating the essential parts of an alternative embodiment of the illuminating apparatus according to the present invention.
Figure 12:
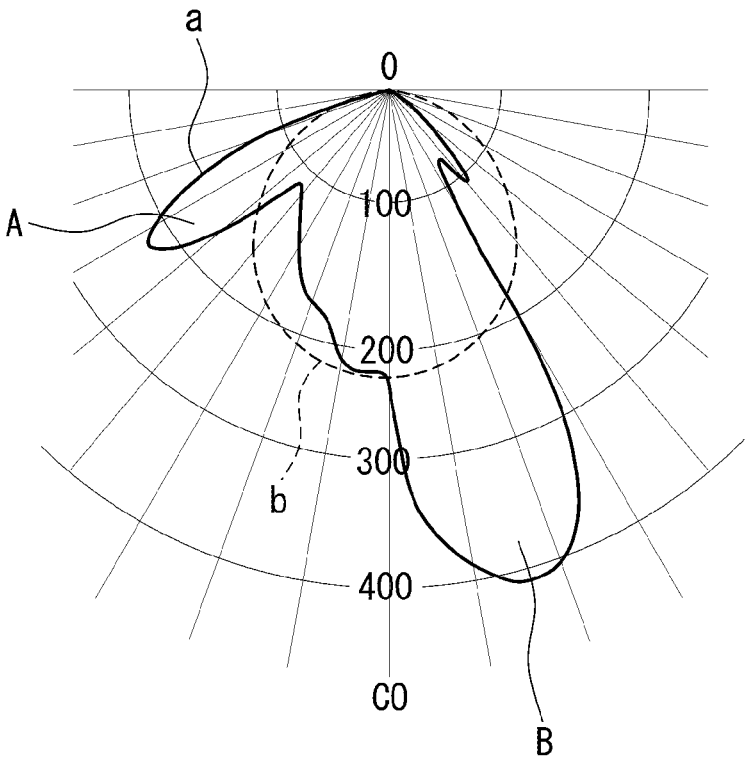
FIG. 12 Prior Art
FIG. 12 is a graph illustrating the light distribution characteristics of a conventional illuminating apparatus.
Figure 13:
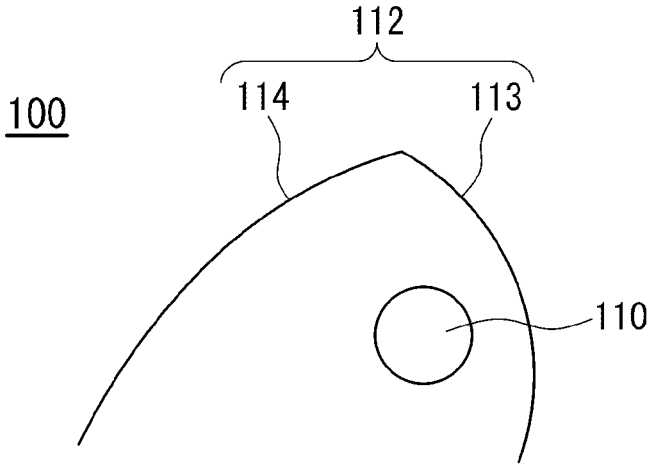
FIG. 13 Prior Art
FIG. 13 is a side surface view illustrating the essential parts of a conventional illuminating apparatus having the light distribution characteristics illustrated in FIG. 12.

For example, the illuminating apparatus according to the present invention can be configured like an illuminating apparatus 60 illustrated in FIG. 11, in which a plurality of prisms 16 and 23 provided on an optical member 64 are disposed on a principal surface (emitting surface) 64*a* of the optical member 64 on the opposite side of a principal surface 64*b* on the side that faces the light source 12. The illuminating apparatus 60 illustrated in FIG. 11 has a structure in which a plurality of refracting prisms 23 are provided near the reference plane and reflecting prisms 16 are provided on the outsides of the refracting prisms 23.

Each reflecting prism 16 includes a pair of prism surfaces 16*a* and 16*b* consisting of a first surface 16*a* that faces the reference axis C1 and a second surface 16*b* that reflects at least a portion of light that enters into the reflecting prism 16. However, in this case, emitted light from the light source 12 enters into each reflecting prism 16 from the principal surface 64*b* side of the optical member 64 that faces the light source 12, is reflected at the second surface 16*b*, passes through the first surface 16*a*, and then is emitted as illumination light.

Further, in the example illustrated in FIG. 11, the plurality of refracting prisms 23 all include a first surface 23*a* (refracting surface) that faces the opposite side of the optical axis C2. Thus, by configuring the plurality of refracting prisms 23 to include the refracting surfaces 23*a* whose tilt directions relative to a principal surface (e.g., the principal surface 64*b*) of the optical member 64 are aligned on one side, the occurrence of stray light can be effectively suppressed.

Moreover, in the illuminating apparatus according to the present invention, the plurality of prisms can be provided on both principal surfaces of the optical member. Also, in the illuminating apparatus according to the present invention, a plurality of light scattering elements formed in, for example, a dome shape can be provided on a principal surface of the optical member on the side on which the plurality of prisms is not disposed, or in a region of the principle surface of the optical member in which the plurality of prisms are not disposed.

Further, the illuminating apparatus according to the present invention can be suitably applied to not only a tunnel lamp or roadway lamp as described above, but also, for example, an indoor light such as a base light or a desk lamp and the like.

What is claimed is:

1. An illuminating apparatus comprising:

a light source, and an optical member that controls light distribution of light emitted from the light source in a forward direction, wherein a plurality of prisms extending in one direction are provided on at least one among two principal surfaces of the optical member in regions on both sides when divided at a virtual plane that includes a reference axis of the optical member, the plurality of prisms include reflecting prisms that reflect light from a light source that is disposed virtually so as to include an optical axis on the virtual plane that includes the reference axis and emit the light from the optical member, and the light source is disposed such that its optical axis is shifted relative to the reference axis to a region on one side when divided at the virtual plane that includes the reference axis.

2. The illuminating apparatus according to claim 1, wherein a plurality of prisms disposed near the virtual plane that includes the reference axis are configured as refracting prisms that refract the light from the light source that is disposed virtually so as to include an optical axis on the virtual plane that includes the reference axis and emit the light from the optical member.

3. The illuminating apparatus according to claim 2, wherein a boundary between the reflecting prisms and the refracting prisms provided on a side on which the light source is disposed among the regions on both sides when divided at the virtual plane that includes the reference axis is located more toward the reference axis than the optical axis of the light source.

4. The illuminating apparatus according to claim 1, wherein the light source is disposed more toward the optical member than a focal point of the plurality of reflecting prisms.

5. The illuminating apparatus according to claim 1, wherein the plurality of prisms are divided into a plurality of small regions at at least one virtual plane parallel to the virtual plane that includes the reference axis, and one or more prisms disposed in each of the plurality of small regions are configured to have each different focal length than the focal length of the one or more prisms disposed in adjacent small regions.

6. The illuminating apparatus according to claim 5, wherein one or more of the reflecting prisms disposed in each of the plurality of small regions included on a side on which the light source is disposed among the regions on both sides when divided at the virtual plane that includes the reference axis are configured such that the focal length thereof decreases as the small regions are distanced from the reference axis.

7. The illuminating apparatus according to claim 1, wherein the plurality of prisms is provided on a principal surface of the optical member that faces the light source, and each of the reflecting prisms includes a first surface that faces the reference axis and a second surface that reflects at least a portion of light that enters from the first surface to the side of the principal surface of the optical member on which the plurality of prisms are not provided.

* * * * *